US010322443B2

(12) United States Patent
Frost et al.

(10) Patent No.: US 10,322,443 B2
(45) Date of Patent: Jun. 18, 2019

(54) PRESS-FORMING TOOL WITH TOLERANCE COMPENSATION

(71) Applicant: BENTELER AUTOMOBILTECHNIK GMBH, Paderborn (DE)

(72) Inventors: Georg Frost, Steinheim (DE); Oliver Luetkemeyer, Paderborn (DE); Josef Koester, Hoexter (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 0 days.

(21) Appl. No.: 14/835,941

(22) Filed: Aug. 26, 2015

(65) Prior Publication Data

US 2016/0059296 A1 Mar. 3, 2016

(30) Foreign Application Priority Data

Aug. 27, 2014 (DE) ..... 10 2014 112 325

(51) Int. Cl.
*B21D 24/02* (2006.01)
*B21D 37/04* (2006.01)
(Continued)

(52) U.S. Cl.
CPC ..... *B21D 37/04* (2013.01); *B21D 24/02* (2013.01); *B30B 15/06* (2013.01); *B30B 15/061* (2013.01);
(Continued)

(58) Field of Classification Search
CPC ..... B21D 24/02; B21D 37/04; B21D 37/06; B21D 37/10; B21D 22/10; B21D 22/02;
(Continued)

(56) References Cited

U.S. PATENT DOCUMENTS 2,400,004 A * 5/1946 Jager ..... B21D 22/10 72/466.9
3,194,047 A * 7/1965 Eggert, Jr. ..... B21D 22/206 72/349
(Continued)

FOREIGN PATENT DOCUMENTS

CN 103702781 A 4/2014
DE 19718857 A1 11/1988
(Continued)

OTHER PUBLICATIONS

Office Action dated Feb. 3, 2017 for Chinese Patent Application No. 201510768416.2.
(Continued)

*Primary Examiner* — Teresa M Ekiert
(74) *Attorney, Agent, or Firm* — Hauptman Ham, LLP

(57) ABSTRACT

The present invention relates to a press-forming tool having a top die and a bottom die, which can be moved toward one another, forming a forming cavity between the top die and the bottom die when the press-forming tool is closed, wherein a die clamping plate is arranged on a press ram and/or on a press table, wherein a top die or bottom die, which can be moved relative to the die clamping plate, is supported on said plate while incorporating at least one resilient adjusting element.

10 Claims, 8 Drawing Sheets

Figure 1:
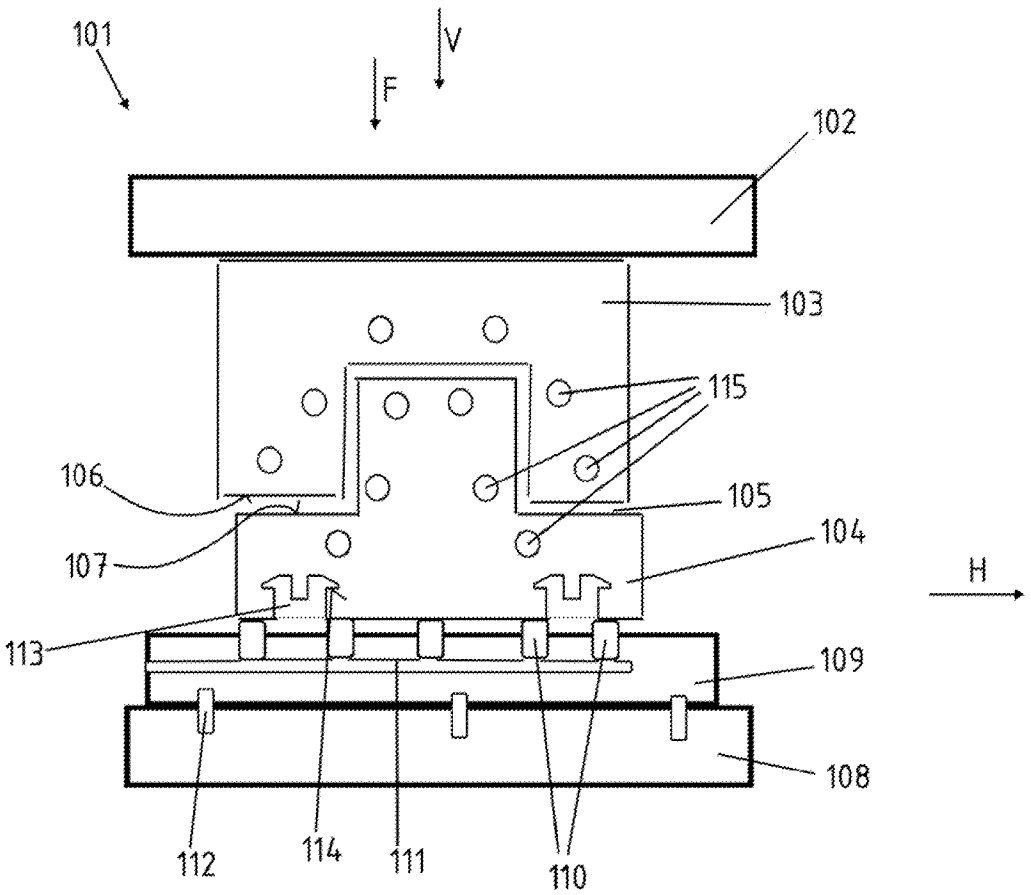

(51) Int. Cl.
*B30B 15/06* (2006.01)
*B30B 15/24* (2006.01)
*C21D 1/673* (2006.01)

(52) U.S. Cl.
CPC ..... *B30B 15/064* (2013.01); *B30B 15/067* (2013.01); *B30B 15/245* (2013.01); *C21D 1/673* (2013.01)

(58) Field of Classification Search
CPC .... B21D 22/24; B21D 22/206; B21D 24/005; B21D 37/02; B21D 43/02; B21D 43/05; B30B 15/06; B30B 15/061; B30B 15/064; B30B 15/245; B30B 15/24
See application file for complete search history.

(56) References Cited

U.S. PATENT DOCUMENTS

| | | | | |
|---|---|---|---|---|
| 3,197,996 | A * | 8/1965 | Zeder, Jr. | B21D 37/10 72/348 |
| 7,823,430 | B2 * | 11/2010 | Hammar | B21D 37/10 29/421.1 |
| 2009/0090161 | A1 | 4/2009 | Amino | |
| 2013/0205863 | A1 * | 8/2013 | Loesch | B21D 37/08 72/342.7 |
| 2014/0304991 | A1 * | 10/2014 | Lin | B21D 22/02 29/897.3 |

FOREIGN PATENT DOCUMENTS

| | | | | |
|---|---|---|---|---|
| DE | 4415577 | A1 | 11/1995 | |
| DE | 102012002559 | A1 | 9/2012 | |
| EP | 1240998 | A2 | 9/2002 | |
| EP | 1240998 | A3 | 7/2003 | |
| EP | 1403017 | A2 | 3/2004 | |
| EP | 1403017 | A3 | 10/2005 | |
| EP | 1803548 | A1 | 7/2007 | |
| EP | 1803549 | A1 | 7/2007 | |
| EP | 2017071 | A1 | 1/2009 | |
| JP | 59094533 | A * | 5/1984 | B21D 22/24 |
| JP | 2006305621 | A | 11/2006 | |
| JP | 2010042426 | A | 2/2010 | |

OTHER PUBLICATIONS

Chinese Office Action, Application No. 201510768416.2, dated Nov. 28, 2017, 16 pages.
"Pressing Process and Mold Design", Jia Lili et al., pp. 121-122, Posts and Telecom Press, Sep. 30, 2008, 4 pages.
Office Action in CN Application No. 201510768416.2, dated Jul. 31, 2018, 16pp.

* cited by examiner

PRESS-FORMING TOOL WITH TOLERANCE COMPENSATION

RELATED APPLICATIONS

The present application claims priority from German Application Number 10 2014 112 325.5, filed Aug. 27, 2014.

The present invention relates to a press-forming tool having a top die and a bottom die.

Press-forming tools for producing formed sheet-metal components are known from the prior art. For this purpose, a sheet-metal blank is placed in the press-forming tool and is then formed by moving a top die and a bottom die toward one another. To do this, a top die is generally lowered with the aid of a press ram, wherein forming of the blank begins when contact is made by the top die with the blank and by the blank with the bottom die and continues until the top die and the bottom die are closed in such a way that there is a forming cavity remaining between the top die and the bottom die, enclosing the blank. In the forming cavity, the formed blank is then brought to the final shape to the component to be produced by the press-forming operation. Given a plurality of top dies arranged adjacent to one another in a press, so that two, three or more blanks are simultaneously formed in parallel to a component, there may be a difference in the contact between the individual dies. These simultaneously produced components are subject to small production tolerances owing to distortion of the top die, the bottom die, the press table and/or the press ram and to deviations in the tolerances of the top dies and/or the bottom dies relative to one another.

Hot forming and press hardening for hardenable steel alloys are furthermore known in the prior art. In this case, blanks consisting of a hardenable steel alloy are heated to a temperature above AC3, resulting in complete austenitization thereof. These heated blanks are then placed in the press-forming tool and formed in the hot condition. After completion of press forming, with the press-forming tool fully closed, the component is then preferably cooled down rapidly in the press-forming tool in such a way that quench hardening occurs. This process is also known as press hardening. If there is no longer immediate and direct contact between the surface of the component in the press-forming tool and the inside of the die surfaces owing to the above-mentioned tolerances, the cooling effect is reduced in these areas due to small air gaps and there is a lower cooling rate.

It is therefore an object of the present invention to indicate a press-forming tool in which a possibility of compensating the top die and/or the bottom die is provided, ensuring that production tolerances which occur during press forming, especially in the case of multiple-die tools, are reduced and better heat dissipation occurs in the case of quench hardening, where applicable.

According to the invention, the abovementioned object is achieved by means of a press-forming tool having a top die and a bottom die.

Advantageous embodiments of the present invention form the subject matter of the dependent patent claims.

The press-forming tool has a top die and a bottom die, which can be moved toward one another, forming a forming cavity between the top die and the bottom die when the press-forming tool is closed. A blank formed to give a press-formed component comes into contact in a forming cavity, wherein, in particular, the surface of the blank comes into contact with a die surface of the top die and with a die surface of the bottom die. According to the invention, it is now envisaged that a die clamping plate is arranged on a press ram and/or on a press table, wherein a top die or bottom die, which can be moved relative to the die clamping plate, is supported on said plate while incorporating at least one resilient adjusting element.

Within the scope of the invention, a press ram is thus provided in the region of the top die, wherein the press ram has a corresponding receptacle for a die clamping plate, wherein, in turn, the top die itself is then coupled to the die clamping plate. In the case of the bottom die, a press table is provided, on which the die clamping plate is fixed, after which, in turn, the bottom die is fixed on the die clamping plate. In the text which follows, the invention is described such that the die clamping plate can be formed both on the press ram and on the press table. There are therefore three conceivable variant embodiments within the scope of the invention, either the die clamping plate according to the invention with a resilient adjusting element being provided on the top die or a die clamping plate with a resilient adjusting element being provided on the bottom die or, as a third variant, a die clamping plate being provided both on the top die and the bottom die. The following description thus applies equally to the three variant embodiments and can be applied to any of them. However, especially in view of the tooling costs and operating costs which arise, the variant embodiment comprising the resilient adjusting element on the top die is particularly preferred. There is the particular advantage here that only one die, namely the top die, is resiliently supported, and this reduces the production costs for the tool. At the same time, this has the advantage that no dirt can fall into the resilient adjusting elements when the dies are changed or during the operation of the tool, owing to gravity.

If there are now tolerances of the blank and/or tolerances or wear on the top die relative to the bottom die and/or displacement of the top die and the bottom die relative to partial areas of the die surfaces and the surface of the blank, which would not be in contact, this can be avoided according to the invention by tolerance compensation through relative displacement. At the same time, low-cost and logistically simple die changing can be achieved. Only the die clamping plate remains on the press ram or, alternatively, on the press table, and the forming die, the top die or the bottom die corresponding thereto are replaceable, e.g. in the event of wear or in the case of a change in production series, thus allowing a new generation of press-formed components or indeed a different production batch to be produced with top and bottom dies of a different kind.

By virtue of the resilient adjusting element, the top die and/or the bottom die is supported in such a way as to be capable of movement relative to the die clamping plate.

First of all, the die clamping plate ensures that the press force is distributed uniformly to the top die by the resilient adjusting elements distributed on the die clamping plate. If there is skewing, there is readjustment and thus evening out of the forming forces to be transmitted owing to the relative movement and the subsequent difference in the distribution of the forming forces on the various resilient adjusting elements.

Particularly where the press-forming tool according to the invention is designed as a hot-forming and/or, in particular, press-hardening or quenching tool, virtually full-surface contact between the die surfaces and the surface of the blank or the press-formed component produced is thus ensured at all times.

According to the invention, this results particularly in the advantage that it is ensured, when performing quench hardening, that the component has the desired quenching temperature and thus the desired hardened structure in a uniform way and, in particular, in all the regions required. If small air gaps result in lower cooling rates, either higher cooling capacities and/or larger time windows are employed to ensure that the components to be press-hardened have the desired properties of the hardened structure through a reliable process. However, these time windows and/or additional cooling capacities can be significantly reduced within the scope of the invention since, owing to the substantially full contact, there is better heat transfer from the surface of the component to the surface of the dies. For this purpose, the top die and the bottom die, in particular, are then provided with cooling passages, allowing appropriate coolant to be passed through.

As a further particularly preferred option, the die clamping plate is coupled, in particular screwed, to the press table, or the die clamping plate is coupled, in particular screwed, to the press ram. If the die clamping plate according to the invention is embodied with a resilient adjusting element on the top die and on the bottom die, the press table would then be coupled to a die clamping plate, and the press ram would be coupled to another die clamping plate. Here there is the advantage, upon initial commissioning of a press-forming tool according to the invention, that said tool is provided in that form, and then all that is necessary is to exchange the forming die parts or die segment parts and hence the top die and the bottom die for the press forming of different products. As a result, die management is significantly more economical, especially in the case of production changeovers, improvements and/or replacement of worn die parts.

Since the press-forming force is transmitted in a particularly uniform way, the resilient adjusting elements are arranged in rows offset in parallel on the die clamping plate. For this purpose, a row consists of a plurality, in particular 1 to 50, particularly preferably to 30 and very particularly preferably 3 to 20, adjusting elements, in which case at least 2, particularly preferably, once again, 2 to 30, in particular 3 to 20, rows of adjusting elements are arranged offset parallel to one another. As a particularly preferred option, the rows themselves are furthermore at the same spacing as the individual adjusting elements within a row. There is therefore a uniformly distributed pattern of resilient adjusting elements over the die clamping plate, thus allowing the press-forming force to be distributed in a correspondingly uniform manner. It is furthermore conceivable within the scope of the invention for the adjusting elements to be arranged in a manner distributed, in particular asymmetrically distributed, on the die clamping plate. It would furthermore be conceivable within the scope of the invention for the distribution of the resilient adjusting elements on the rear side to be matched to the contour of the top die or bottom die. It is thus possible to take account of the particular shape of the press-formed component to be produced, for example. Moreover, more resilient adjusting elements can be arranged in regions in which forming forces are concentrated, that is to say a larger number or concentration of adjusting elements per unit area, in order to compensate for the occurrence of higher forming forces, as compared with regions in which only relatively low forming forces are necessary. As a further particularly preferred option within the scope of the invention, at least individual spring adjusting elements can be locked in each case. This would be particularly preferred in the case of spring adjusting elements arranged in a row, allowing a complete row to be locked, for example. However, it would also be conceivable within the scope of the invention for individual spring adjusting elements to be locked selectively.

In the most simple embodiment, the resilient adjusting elements are designed as mechanical springs, in particular. As a very particularly preferred option, helical compression springs are used for this purpose.

However, diaphragm springs, helical diaphragm springs and/or sleeve springs are also conceivable. Within the scope of the invention, an arrangement such that the resilient adjusting elements themselves are arranged under a preload between the top die and the die clamping plate or the bottom die and the die clamping plate is then conceivable here. An appropriate preload is then necessary here, particularly during assembly or when changing the top die and the bottom die.

However, it is also possible within the scope of the invention for the resilient adjusting element to be designed as a pneumatic and/or hydraulic spring element. For this purpose, two different operating variants are then in turn conceivable. On the one hand, the pneumatic and/or hydraulic spring element can be operated passively. This means that, as the press pressure increases, the spring characteristics ensure that a corresponding spring characteristic curve is established, and the press force and hence the clamping force is transmitted to the sheet-metal blank to be formed or to the formed component in the bottom dead center position of the press.

However, it is also possible within the scope of the invention for the resilient adjusting element to be designed as an actuator and additionally to be actively controllable. When the bottom dead center position is reached here, the press force transmitted via the resilient adjusting element can then be increased further by applying an operating pressure, for example, and closing any gap that may be present in the cavity between the die surface and the surface of the component by means of the increased press force and an associated relative movement of the top die and/or the bottom die. However, it is also conceivable within the scope of the invention for a corresponding operating pressure to be applied to the resilient adjusting elements even during the closing of the press.

As a particularly preferred option, a damping support is furthermore arranged between a rear side of the top die and the die clamping plate or, alternatively, between a rear side of the bottom die and the die clamping plate. The damping support is preferably a damping layer for the purpose of avoiding metal-to-metal impacts. In particular, the damping support prevents metal-to-metal impacts when opening the press-forming tool, ensuring that there is no contact between the top die and the die clamping plate or between the bottom die and the die clamping plate, which would prejudice the production process. In particular, the damping support can be formed from plastic or a rubber-type material, for example, and, in particular, is applied over an extensive area and/or in strip form. It can also be applied in spot form.

As another particularly preferred option, contact bars which project relative to a surface of the die clamping plate are provided on the die clamping plate. When a predetermined forming force and/or the bottom dead center position is/are reached, the rear side of the top die or the rear side of the bottom die, in particular, would thus come into contact at least over a certain area with the contact bars and then transmits/transmit the forming force directly and not only via the resilient adjusting element. Unwanted displacement due to excessive relative movement and/or unwanted forming behavior of the blank is/are thereby avoided.

It is furthermore conceivable within the scope of the invention for the bottom die or the top die and, in some cases, both dies to be of segmented design, wherein the individual segments are supported on the die clamping plate in such a way as to be capable of relative movement. These are then also each supported in such a way as to be capable of movement relative to the die clamping plate.

Another advantageous variant embodiment of the invention envisages that at least two top dies or at least two bottom dies are arranged adjacent to one another on a die clamping plate, wherein the two top dies or the two bottom dies are supported in such a way as to be movable relative to one another. In particular, this is to be understood as a multiple-die tool, with the result that, by virtue of identical or different top dies and bottom dies arranged adjacent to one another, it is nevertheless possible to produce identical components in one press stroke. It is also conceivable, within the scope of the invention, for top dies or bottom dies that differ from one another to be arranged transversely to the press ram or on the press table, thus allowing different components to be produced with a single press stroke. In particular, it is possible once again here, by virtue of the relative movement, to ensure that all the components have the required degree of forming and, in particular, the required contact points for a press operation during a press stroke, making it possible to achieve the desired hardened structures in a selective manner.

To enable a higher accuracy to be achieved, particularly when performing the closing movement, it is furthermore envisaged that a centering mandrel is arranged between the press ram and the press table, said mandrel guiding the closing movement of the press ram and the press table linearly, in particular vertically, in the direction of the press stroke. This ensures that the relative movement due to the resilient adjusting element is performed essentially exclusively in the direction of the press stroke and not transversely to the direction of the press stroke. Within the scope of the invention, it is also conceivable for the centering mandrel to be arranged between the top die and the bottom die, ensuring that said centering mandrel, in particular, avoids a corresponding relative movement precisely in the transverse direction relative to the press stroke.

To ensure that the top die is coupled to the die clamping plate or the bottom die is coupled to the die clamping plate, it is conceivable that screw bolts that pass through the resilient adjusting elements and/or are integrated into the resilient adjusting elements are provided, allowing die assembly to be carried out. At the same time, especially in the case of the screw bolts passing through the adjusting elements, it is possible to achieve corresponding preloading of the resilient adjusting elements during die assembly. As a particularly preferred option, however, the top die and the bottom die are supported positively by means of sliding blocks, in particular by means of double-T sliding blocks, on the die clamping plate. Here, a minimum possible tolerance or displacement and, consequently, lateral guidance is provided, especially in a horizontal direction, wherein linear guidance is provided in a vertical direction, that is to say in the direction of the press stroke, thus allowing the top die and the bottom die to move relative to the die clamping plate in the manner predetermined by the resilient adjusting elements.

A second variant embodiment of the present invention envisages that the top die and/or the bottom die are coupled by means of sliding blocks in such a way as to be capable of relative movement on the die clamping plate, wherein a sliding block has a guiding portion and an abutment portion. For this purpose, the sliding blocks are particularly preferably of T-shaped design. The T bar forms the guiding portion, which also simultaneously provides linear guidance in a vertical direction and avoids relative movement transversely to the direction of the press stroke. The crosspiece of the T forms an abutment portion, ensuring that a relative movement is limited when the crosspiece is reached. If, for example, the die clamping plate is fastened on the top die, it is coupled to the press ram. When the press-forming tool is opened, that is to say an upward movement of the top die is performed, a relative movement is first of all performed along the T bar from the bottom dead center position. Consequently, only the press ram is initially raised. If the press ram continues to be moved in the direction of the top dead center position, the top die comes into contact with the crosspiece. The relative movement is now limited in the direction of the press stroke and, if the press ram is raised further with the coupled die clamping plate, the top die is likewise also raised. In the case of the bottom die, a movement of the bottom die relative to the die clamping plate is then performed owing to the spring force of the resilient adjusting element. When the bottom die reaches the crosspiece of the T shape, a further relative movement is no longer possible.

Figure 2:
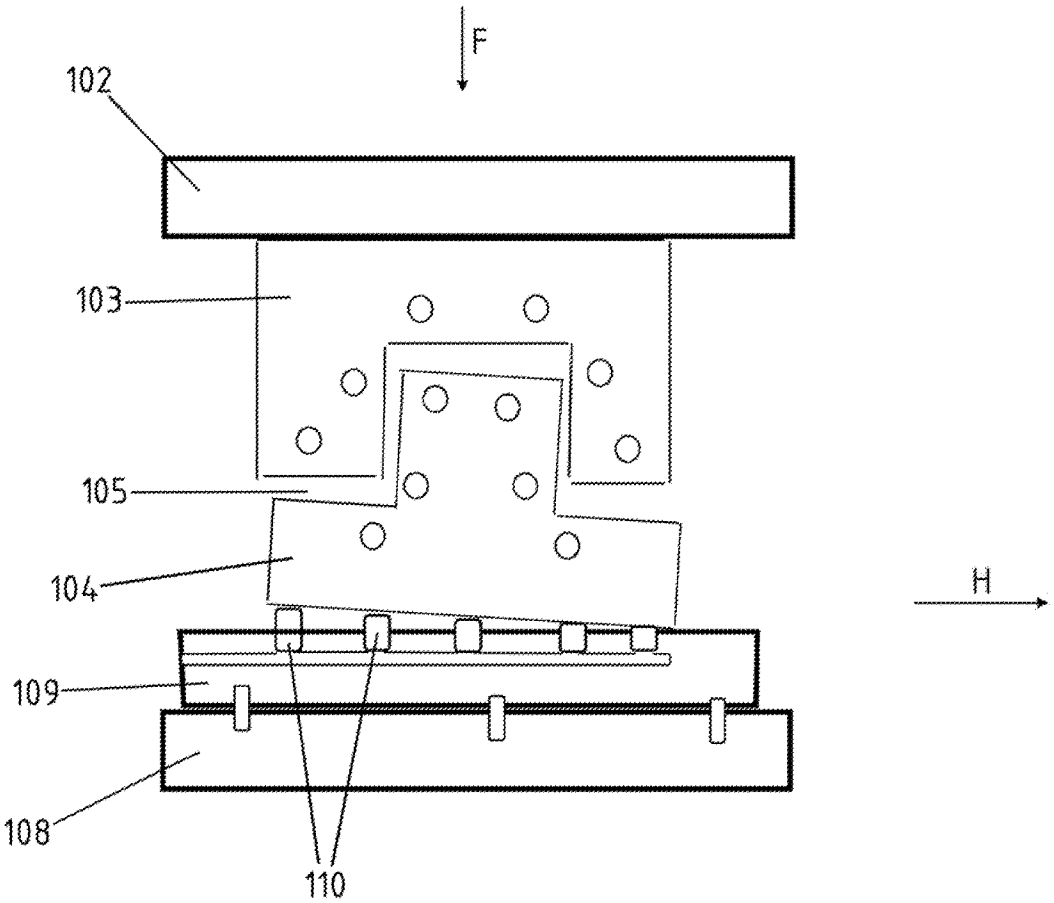
Figures 3A, 3B:
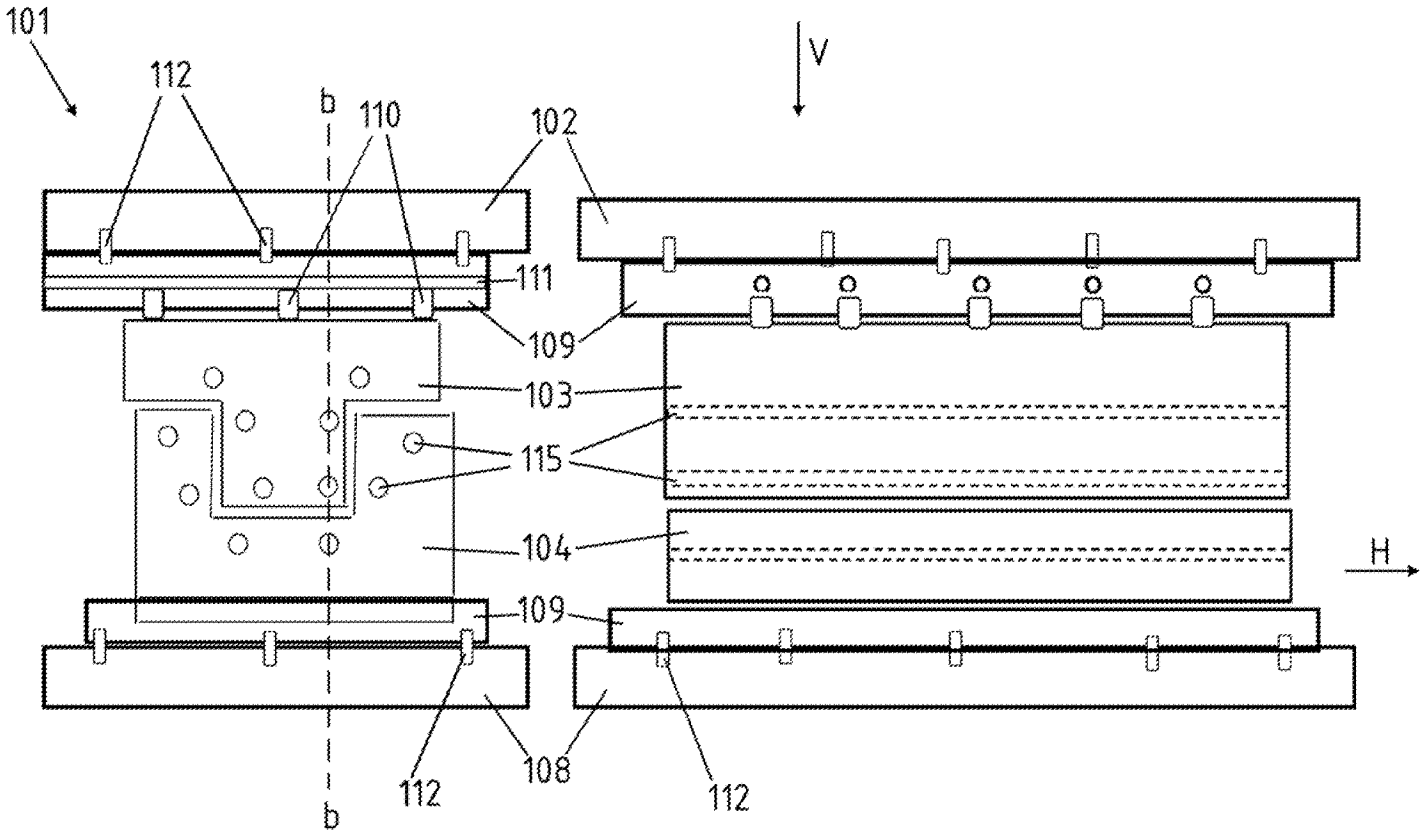
Figure 4:
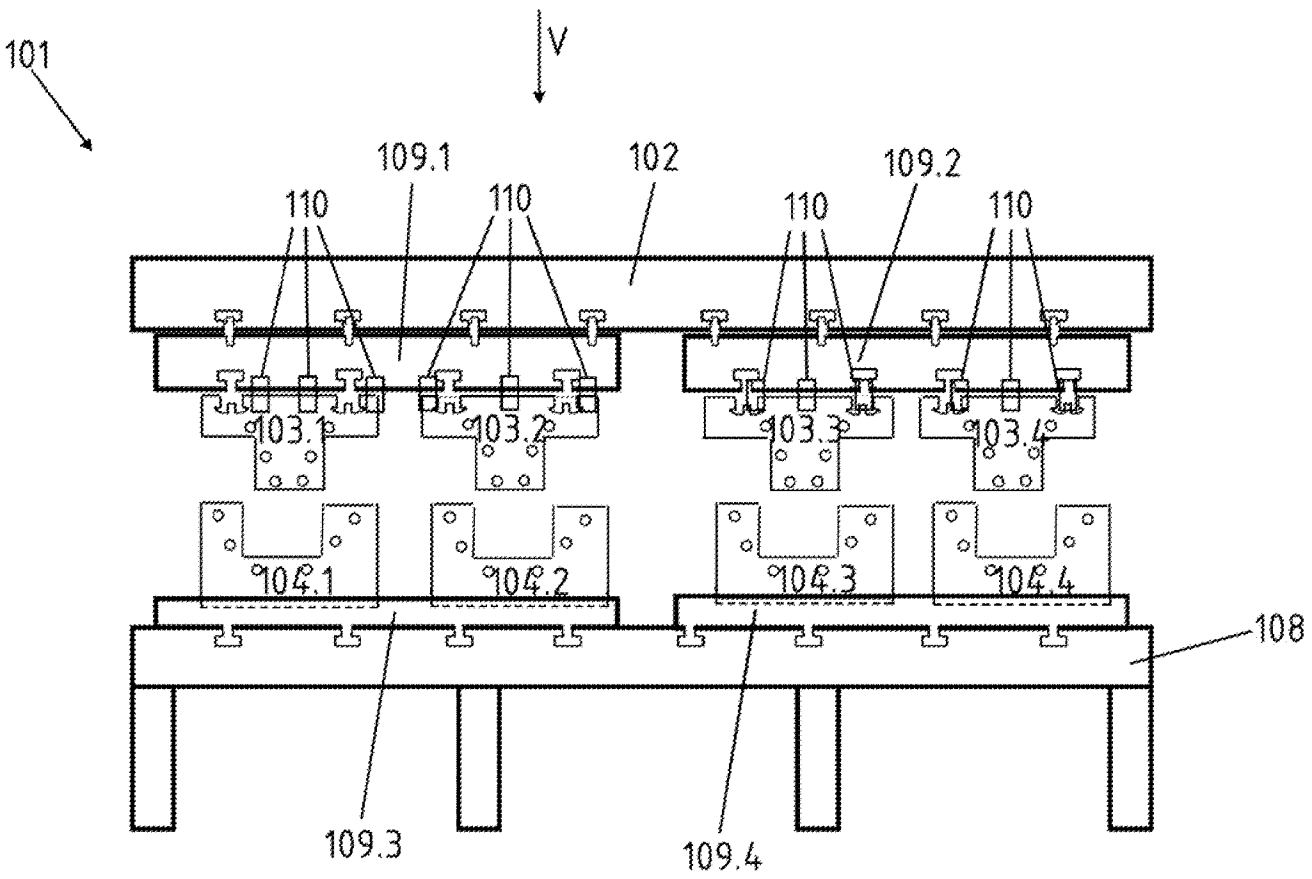
Figure 5B:
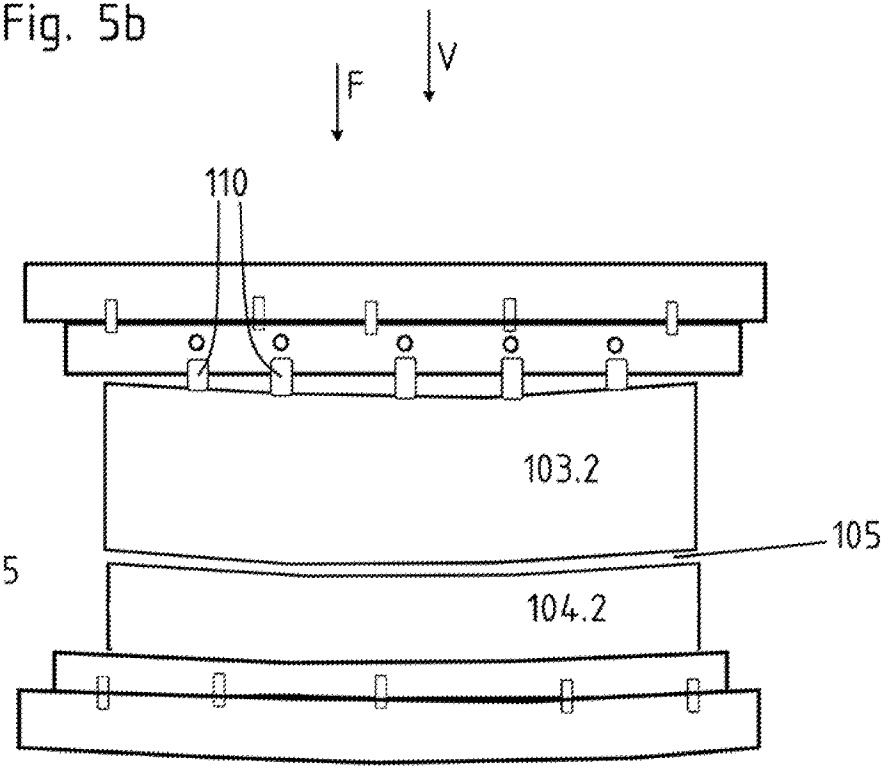
Figure 5A:
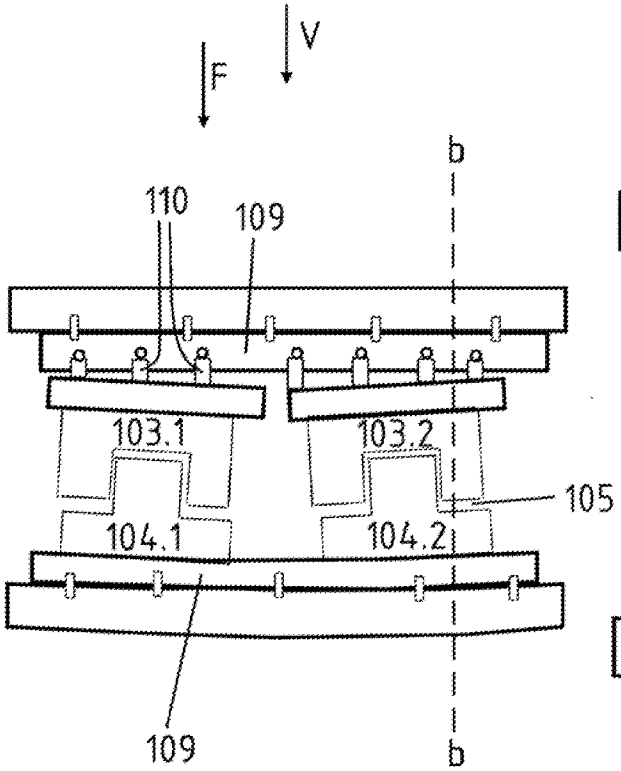
Figure 6:
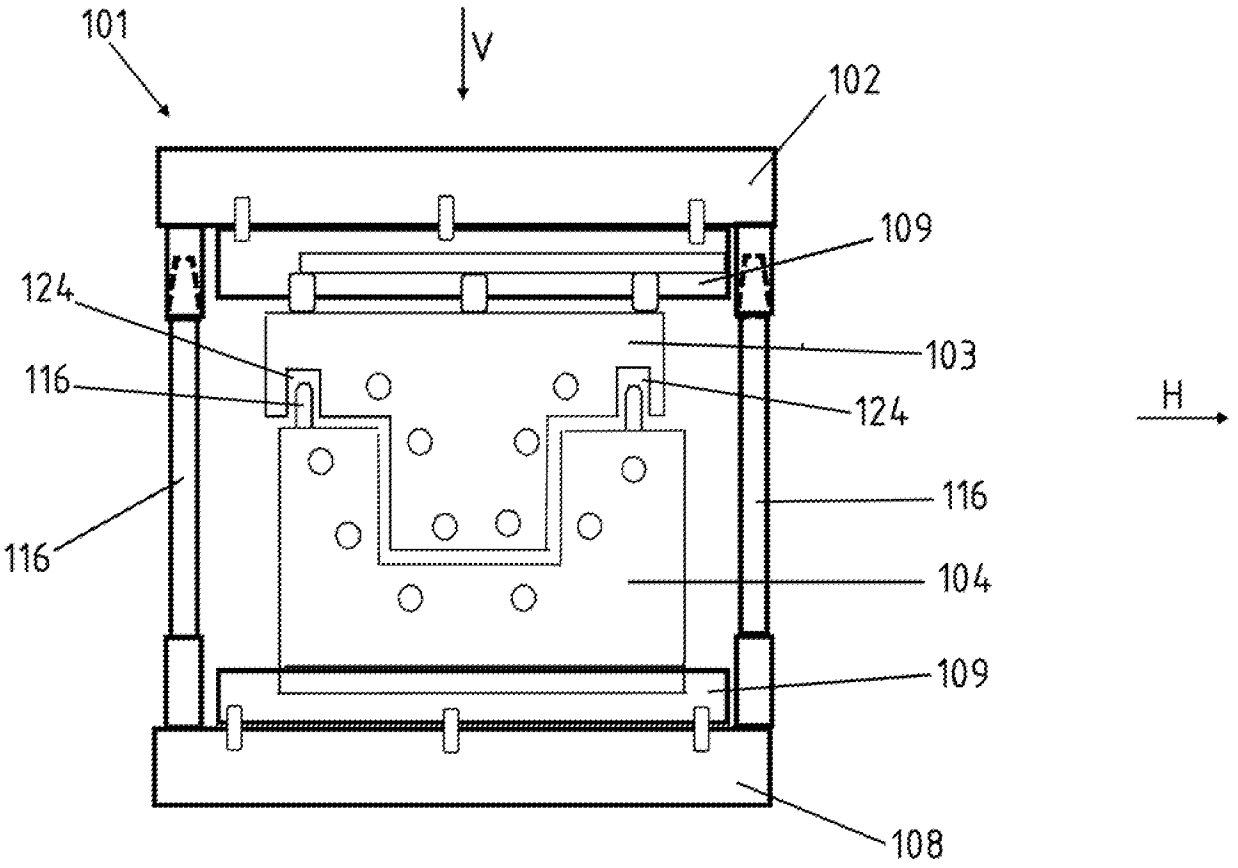
Figure 7B:
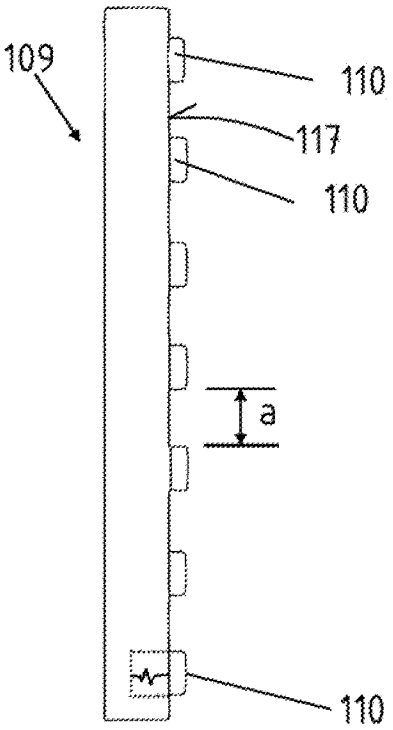
Figure 7A:
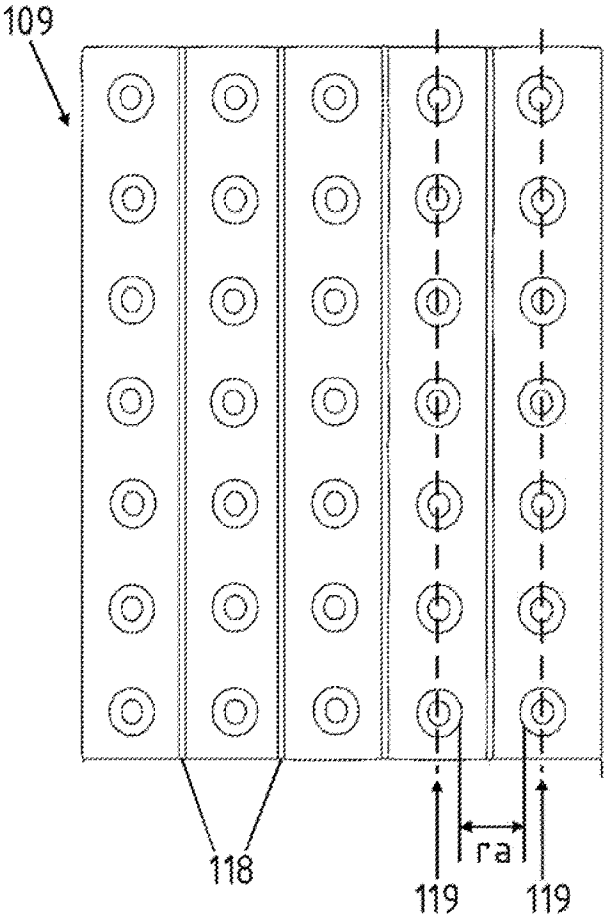
Figure 8:
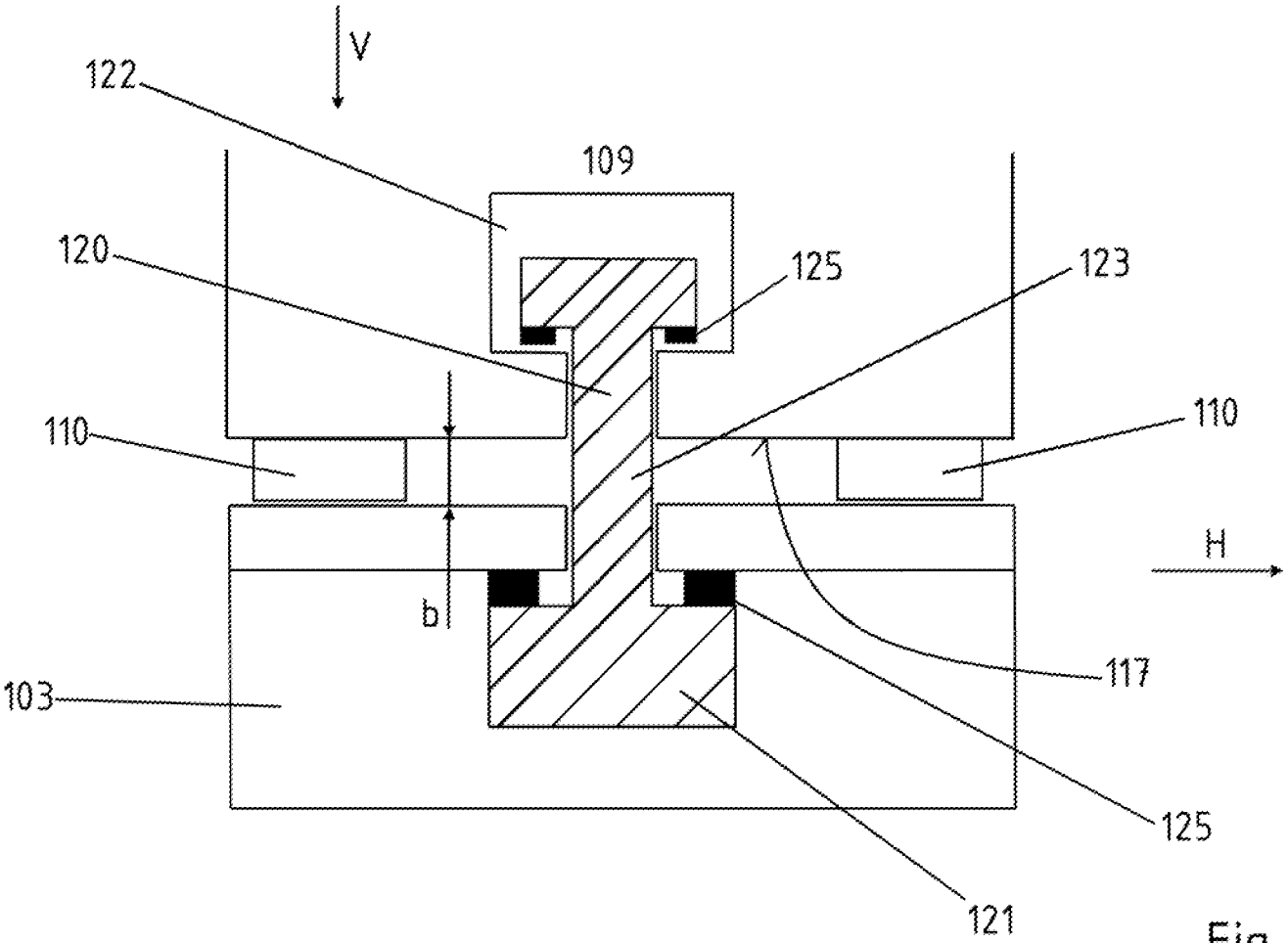

Further advantages, features, characteristics and aspects of the present invention form the subject matter of the following description. Preferred variant embodiments are shown in the schematic figures. These help the invention to be understood easily. In the drawing:

FIG. 1 shows a press-forming tool according to the invention having a resilient adjusting element in the region of the bottom die, FIG. 2 shows a schematic view of the press-forming tool according to FIG. 1 in a skewed position, FIGS. 3*a* and 3*b* show a press-forming tool according to the invention in a cross-sectional view and a side view with a resilient adjusting element in the region of the top die, FIG. 4 shows a quadruple-die press-forming tool with in each case two die clamping plates arranged adjacent to one another, FIGS. 5*a* and 5*b* show a double-die tool in a cross-sectional and longitudinally sectioned view, FIG. 6 shows a press-forming tool according to the invention with a centering mandrel, FIGS. 7*a* and 7*b* show a die clamping plate according to the invention in plan view and side view, and FIG. 8 shows a cross-sectional detail view of a double-T sliding block.

In the figures, the same reference signs are used for identical or similar components, even if the description is not repeated for reasons of simplicity.

The press-forming tool 101 according to the invention is shown in a cross-sectional view from the side in FIG. 1. In this connection, the press-forming tool 101 has a press ram 102, which is shown from the top down in the plane of the drawing, wherein the top die 103 is coupled to the press ram 102 in a manner not shown specifically. Via the press ram 102, a press force F in relation to a vertical direction V, which simultaneously corresponds to the press stroke movement, is applied, and the top die 103 and a bottom die 104 are closed. Between the top die 103 and the bottom die 104 there remains a forming cavity 105 containing a blank (not shown specifically), wherein, within the scope of the invention, the blank particularly preferably comes into full-surface contact with the respective die surfaces 106, 107. For this purpose, provision is made, according to the invention, for a die clamping plate 109 to be arranged on a press table 108 and for various resilient adjusting elements 110 to be arranged between the bottom die 104 and the die clamping plate 109. By means of the resilient adjusting elements 110, it is possible for the bottom die 104 to perform the relative movement shown on an exaggerated scale in FIG. 2 substantially in vertical direction V. During this process, a guide (not shown specifically) prevents the bottom die 104 from sliding off in the horizontal direction H itself. Also shown is a fluid line 111, by means of which the resilient adjusting elements 110 can be actively controlled. In the context of the invention, actively controlled means, in particular, that the spring characteristics and/or damping characteristics of the resilient adjusting elements 110 are adjustable. Alternatively or in a supplementary sense, actively controllable in the context of the invention can also mean that the resilient adjusting elements 110 can be locked by this means. The die clamping plate 109 itself is firmly coupled to the press table 108 by means of bolts 112. The bottom die 104 is furthermore in turn coupled to the die clamping plate 109 by means of sliding blocks 113. For greater ease of understanding, the sliding blocks 113 are shown on a greatly enlarged scale. In this connection, the sliding blocks 113 have an end stop 114 in the region of a T-shaped bar, with the result that no relative movement between the die clamping plate 109 and the bottom die 104 beyond the end stop 114 is possible. Moreover, both the top die 103 and the bottom die 104 have cooling passages 115, through which an appropriate coolant can be passed, thus allowing press hardening to be performed. In the variant embodiment shown in FIG. 2, a die clamping plate 109 could additionally or alternatively be arranged between the press ram 102 and the top die 103.

An alternative variant embodiment is shown in cross-sectional and longitudinally sectioned view in FIGS. 3*a* and b. In this connection, the press-forming tool 101 shown in FIG. 3 once again has a press ram 102 and a press table 108. Here, the bottom die 104 is fixed on a die clamping plate 109, wherein the die clamping plate 109 itself is coupled to the press table 108 by means of bolts 112. Here, however, no resilient adjusting elements are incorporated between the die clamping plate 109 and the bottom die 104. Here, they are shown incorporated on the top die 103, and, once again, they can also be actively controllable by means of a fluid line 111. The advantage, particularly with this variant embodiment, is that no contaminants can fall in vertical direction V between the top die 103 and the die clamping plate 109 due to gravity, and hence free movement is always possible to perform the relative movement. The die clamping plate 109 is once again fixed on the press ram 102 by means of bolts 112. Corresponding cooling passages 115 are furthermore shown here.

FIG. 4 shows a variant embodiment of a press-forming tool 101 according to the invention as a quadruple-die tool. In this connection, four top dies 103.1, 103.2, 103.3, 103.4 are arranged adjacent to one another on two die clamping plates 109.1, 109.2, which are likewise arranged adjacent to one another on the press ram 102. Four bottom dies 104.1, 104.2, 104.3, 104.4 are formed in a manner corresponding to the four top dies 103.1, 103.2, 103.3, 103.4, wherein the four bottom dies 104.1, 104.2, 104.3, 104.4 are each arranged in pairs in a corresponding manner on corresponding die clamping plates 109.3, 109.4 on the press table 108. When a stroke motion is performed in vertical direction V, the incoming top die 103.1, 103.2, 103.3, 103.4 can thus in each case align itself relative to the bottom die 104.1, 104.2, 104.3, 104.4 in such a way that, when the bottom dead center position is reached, there is corresponding uniform and full-surface contact and/or tolerance compensation. The two die pairs on each die clamping plate 109 can also be two process stages in temporal succession. For example, a hot forming operation can be performed in the first die pair and a cooling stage in the form of press hardening can be performed in the second die pair. Both stages are then performed in the same press cycle. However, the resilient support makes it possible, in particular once again, to accommodate the different extent of the dies required for each process stage. Resilient adjusting elements 110 are furthermore shown schematically and by way of example between the die clamping plate 109 and the respective top die 103.

This is shown by way of example in FIGS. 5*a* and *b*, which show a sectional view through a double-die tool shown here. In this case, two top dies 103.1, 103.2 and two bottom dies 104.1, 104.2 are each arranged on a die clamping plate 109. Here, the top dies 103 have the resilient adjusting elements 110 according to the invention between them and the die clamping plate 109. If there is then distortion at the bottom dead center position shown here when the press force is exerted, both in the transverse direction shown in FIG. 5*a* and in the longitudinal direction as shown in FIG. 5*b*, the different lengths of the resilient adjusting elements 110 in vertical direction V make it possible to transmit an a homogenization the applied press force F in vertical direction V to the formed component in the forming cavity 105.

FIG. 6 shows a variant embodiment of the press-forming tool 101 according to the invention with a centering mandrel 116 arranged at the outside. This aligns the press ram 102 shown here with the press table 108 in respect of the horizontal direction when the closing movement in vertical direction V is performed. There is therefore centering in the horizontal direction H and linear guidance in the vertical direction V. It would also be conceivable within the scope of the invention for the individual die clamping plates 109 to be aligned relative to one another and/or also for the top die 103 and the bottom die 104 to be aligned relative to one another by means of respective centering mandrels 116. Also shown are respective centering mandrels 116 in the top die 103 and the bottom die 104. The respective centering mandrel then projects, in particular relative to the bottom die 104 shown here, and, in the process, engages in a centering opening 124 in the top die 103.

FIGS. 7*a* and b show a die clamping plate 109 according to the invention in plan view and in side view. It can be seen that the resilient adjusting elements 110 project relative to a surface 117 of the die clamping plate 109. These have a spacing a relative to one another. Also shown in the plan view according to FIG. 7*a* is the fact that the individual rows 119 have a corresponding row spacing ra from one another. The row spacing ra is preferably equal to the spacing a between the individual resilient adjusting elements 110. Clamping slots 118 for inserting sliding blocks 113 (not shown specifically) are furthermore shown, allowing the top die and the bottom die to be coupled to a die clamping plate 109. The resilient adjusting elements 110 can also preferably be in the form of cylinders, for example, e.g. also in the form of cylinder covers, which then in turn accommodate the resilient adjusting element 110, in the form of a helical spring for example, and protect it from wear, damage and contamination. As a further particularly preferred option, the resilient adjusting elements 110 or cylinders have a stroke of up to 50 mm, in particular up to 30 mm and preferably up to 10 mm, relative to the surface 117 of the die clamping plate 109 and, in particular, a stroke of 5 mm, in particular up to 2 mm, preferably less than 1 mm, relative to the surface 117 of the die clamping plate 109.

It is furthermore shown schematically in FIG. 7*b*, with reference to the resilient adjusting element 110 at the bottom relative to the plane of the drawing, that said adjusting element is supported at least partially in the die clamping plate 109 and projects partially relative to the surface 117 of the die clamping plate 109. It would also be conceivable within the context of the invention for the resilient adjusting element 110 to be supported completely in the die clamping plate 109 and then to be extended from the operating position when required, it being possible to envisage this variant embodiment particularly when the resilient adjusting elements 110 are active.

The possibility of coupling a top die 103 to a die clamping plate 109 by means of double-T sliding blocks 120 is furthermore shown schematically in FIG. 8. Here, the resilient adjusting elements 110 hold the top die 103 at a distance b from the surface 117 of the die clamping plate 109. In this case, the double-T sliding block 120 is provided on its respective T bar 121 with a damping support 125, ensuring that there is no impact owing to the respective abutment portion being reached when the opening movement is performed. As shown here, the double-T sliding block 120 can enter a cavity 122 in the die clamping plate 109 when it reaches the bottom dead center position. Also conceivable as an alternative is the presence of a cavity 122 both in the top die 103 and in the die clamping plate 109. An alternative variant embodiment is for a cavity 122 (not shown specifically here) to be present only in the top die 103. It is furthermore shown that the web 123 is in virtually positive engagement in horizontal direction H, and there is therefore guidance here, whereas relative movement is made possible in vertical direction V.

REFERENCE SIGNS

101—press-forming tool
102—press ram
103—top die
104—bottom die
105—forming cavity
106—die surface of 103
107—die surface of 104
108—press table
109—die clamping plate
110—adjusting element
111—fluid line
112—bolt
113—sliding block
114—end stop
115—cooling passage
116—centering mandrel
117—surface of 109
118—clamping slot
119—row
120—double-T sliding block
121—T bar
122—cavity
123—web
124—centering mandrel
125—damping support
a—spacing
b—distance
ra—row spacing
F—press force
H—horizontal direction
V—vertical direction

The invention claimed is:

1. A press-forming tool, comprising:

a top die and a bottom die movable toward one another, and forming a forming cavity between the top die and the bottom die when the press-forming tool is closed;

a die clamping plate arranged on a press ram or on a press table;

at least one resilient adjusting element arranged in the die clamping plate; and sliding blocks coupling at least one of the top die and the bottom die to the die clamping plate in such a way that said at least one of the top die and the bottom die is capable of relative movement on the die clamping plate, wherein said at least one of the top die and the bottom die is movable relative to the die clamping plate, and is supported on the die clamping plate by said at least one resilient adjusting element, wherein each of the sliding blocks is I-shaped and has a guiding portion and an abutment portion, and the sliding blocks are parallel to each other over an entire length of the die clamping plate, and wherein the die clamping plate comprises a plurality of elongated clamping slots for inserting the sliding blocks.

2. A press-forming tool, comprising:

a top die and a bottom die movable toward one another, and forming a forming cavity between the top die and the bottom die when the press-forming tool is closed;

a die clamping plate arranged on a press ram or on a press table;

at least one resilient adjusting element, wherein a portion of the at least one resilient adjusting element is arranged in the die clamping plate and another portion of the at least one resilient adjusting element partially extends from an upper surface of the die clamping plate; and sliding blocks coupling at least one of the top die and the bottom die to the die clamping plate in such a way that said at least one of the top die and the bottom die is capable of relative movement on the die clamping plate, wherein said at least one of the top die and the bottom die is movable relative to the die clamping plate, and is supported on the die clamping plate by said at least one resilient adjusting element, wherein each of the sliding blocks is I-shaped and has a guiding portion and an abutment portion, wherein the sliding blocks are parallel to each other over an entire length of the die clamping plate, wherein the die clamping plate comprises a plurality of elongated clamping slots for inserting the sliding blocks, and wherein the press-forming tool is a hot-forming and press-hardening tool and further comprises cooling passages formed in the top die and/or the bottom die, the cooling passages allowing a coolant/cooling fluid to pass through, allowing press hardening to be performed.

3. The press-forming tool as claimed in claim 2, wherein the die clamping plate is coupled to the press table or wherein the die clamping plate is coupled, or screwed, to the press ram.

4. The press-forming tool as claimed in claim 2, wherein the at least one resilient adjusting element is a mechanical spring, a helical compression spring, or a pneumatic and/or hydraulic spring element.

5. The press-forming tool as claimed in claim 2, wherein the at least one resilient adjusting element is an actuator which is actively controllable.

6. The press-forming tool as claimed in claim 2, further comprising:

a damping support arranged between a rear side of the top die and the die clamping plate, or between a rear side of the bottom die and the die clamping plate.

7. The press-forming tool as claimed in claim 2, wherein the top die or the bottom die is of segmented design with individual segments, and wherein the individual segments are supported on the die clamping plate in such a way as to be capable of relative movement.

8. The press-forming tool as claimed in claim 2, wherein a centering mandrel is arranged between the press ram and the press table, and/or a centering mandrel is arranged between the top die and the bottom die, wherein a closing movement of the press ram and the press table and/or of the top die and the bottom die is guided linearly by the centering mandrel.

9. The press-forming tool as claimed in claim 2, wherein the coupling of the top die and the die clamping plate is accomplished by screw bolts that pass through the at least one resilient adjusting member or by screw bolts integrated into the at least one resilient adjusting element.

10. The press-forming tool as claimed in claim 2, wherein the coupling of the bottom die and the die clamping plate is accomplished by screw bolts that pass through the at least one resilient adjusting member or by screw bolts integrated into the at least one resilient adjusting element.

* * * * *